US006119486A

United States Patent [19]

Morita et al.

[11] Patent Number: 6,119,486

[45] Date of Patent: Sep. 19, 2000

[54] END YARN INSERTING DEVICE OF FLAT KNITTING MACHINE

[75] Inventors: Toshiaki Morita; Kenji Ikoma, both of Wakayama, Japan

[73] Assignee: Shima Seiki Manufacturing Limited, Wakayama, Japan

[21] Appl. No.: 09/451,759

[22] Filed: Dec. 1, 1999

[30] Foreign Application Priority Data

Dec. 16, 1998 [JP] Japan ..... 10-357158

[51] Int. Cl.[7] ..... D04B 15/64

[52] U.S. Cl. ..... 66/60 R; 66/126 R

[58] Field of Search ..... 66/60 R, 64, 65, 66/96 R, 90, 104, 109, 110, 125 R, 126 R, 176 A

[56] References Cited

U.S. PATENT DOCUMENTS

| | | | |
|---|---|---|---|
| 3,691,794 | 9/1972 | Jeffcoat | 66/126 R |
| 4,441,338 | 4/1984 | Betts et al. | 66/60 R |
| 5,031,423 | 7/1991 | Ikenaga | 66/126 R |
| 5,109,681 | 5/1992 | Schmid et al. | 66/126 R |

*Primary Examiner*—Larry Worrell
*Attorney, Agent, or Firm*—Arent Fox Lintner Plotkin & Kahn PLLC

[57] ABSTRACT

An end yarn inserting device that is so constructed that an end yarn hook can be put into action only when necessary but otherwise be retreated to such a position in the vicinity of a needle bed gap as to avoid interfering with knitting members including a yarn feeder and knitting needles. The end yarn inserting device includes guide rails, an end yarn inserting portion including an end yarn hook, and first and second control portions for controllably moving the end yarn hook to a desired position on the needle bed in the X-axis direction and the Y-axis direction, wherein an end yarn hook having a hook portion for retaining a cross-over yarn thereon and an end yarn hook presser foot having a presser foot portion are superposed on each other and swingably journaled around a journal portion provided on a base sidably supported on the guide rail; wherein the end yarn hook and the end yarn hook presser foot are so arranged as to be swung between their retreated positions and their lowered positions in association with the second control portion; and wherein control means for permitting back and forth swinging motions of the hook portion and the hook presser foot are provided between the end yarn hook and the base.

4 Claims, 10 Drawing Sheets

END YARN INSERTING DEVICE OF FLAT KNITTING MACHINE

The present invention relates to an end yarn inserting device for inserting an end yarn as left over, such as a cross-over yarn, arranged in a flat knitting machine, such as a glove knitting machine or a sock knitting machine, comprising at least a pair of spaced apart, front and back needle beds.

In the knitting of a glove, for example, a knitting yarn is fed to the knitting needles to which a little finger portion of the glove is to be allocated from a yarn feeder that moves reciprocally in the longitudinal direction of the needle beds, to knit a finger portion of the little finger, first. Then, the yarn is subsequently fed to the knitting needles to which third, second and first finger portions of the glove are to be allocated, to knit the finger portions in sequence. Thereafter, the knitting of an upper palm portion and the knitting of the subsequent finger portion of the thumb are performed, followed by the knitting of a lower palm portion and the knitting of a wrist portion, for the completion of knitting of the glove.

Each of the finger portions is knitted a proper length, casting on stitches from the tip of a finger toward a crotch portion of the finger at the base end portion thereof. When the finger portions are knitted in this process, a cross-over yarn appears between the base end portions of the finger portions and the fingertip portions of the next finger portions.

For eliminating the need of post handling after the knitting of the glove, the glove knitting machine is equipped with a cross-over yarn cutting and gripping device for cutting and gripping the cross-over yarn in the For eliminating the need of post handling after the knitting of the glove, the glove knitting machine is equipped with a cross-over yarn cutting and gripping device for cutting and gripping the cross-over yarn in the course of knitting of the glove and an end yarn inserting device for inserting end yarn portion of the cross-over yarn into the finger portions.

The applicant previously made the invention on the method and device in connection with the handling of the cross-over yarn as disclosed by Japanese Patent Publications No. Sho 53(1978)-1863 and No. Sho 53(1978)-1864.

These publications disclose that: After a portion of a cross-over yarn, passing through a formerly knitted finger portion at the base end portion thereof and drawn out, is pulled into a needle bed gap between the knitting needles for a next finger portion positioned in their operative positions and is hooked by the end yarn hook positioned at the end of the next finger portion on the side of its being cast on, the fingertip portion of the next finger portion is cast on. Then, the cross-over yarn is cut at a position closest to the finger portion other than the formerly knitted finger portion in the course of the knitting of one or a few courses of the fingertip portion, in the course of which the end yarn hook is made to move up to a position over the needle bed gap and toward the formerly knitted finger portion, together with the yarn feeder, so that a portion of the end yarn appearing in the fingertip portion on the fingertip side thereof can be guided by the end yarn hook to be inserted into the finger portion which is in the course of being knitted or can be knitted together with the yarn fed by the yarn feeder by the plating process to be knitted in the fingertip portion, so as to prevent the cross-yarn from appearing at the outside of the knitted glove.

Japanese Patent Publication No. Sho 53(1978)-1863 discloses the device in which the end yarn hook is set at a lower position than the tip of the yarn feeder so that the end yarn portion appearing in the fingertip portion can be guided by the end yarn hook to be inserted into the finger portion which is being knitted. Japanese Patent Publication No. Sho 53(1978)-1864 discloses the device in which the end yarn hook can be shifted upward to a level equal to the tip end of the yarn feeder only while the end yarn hook set at a lower position than the tip of the yarn feeder, as is the case with the former publication, is being moved, so that the end yarn portion appearing in the fingertip portion and the yarn fed by the yarn feeder can be knitted together in the fingertip portion.

With the above-mentioned arrangement in which the end yarn hook is constantly in a position close to the needle bed gap, when the end yarn hook is moved, a stitch loop retained on the knitting needle can be caught by the end yarn hook to scratch the glove. With another arrangement in which the end yarn hook is constantly in a space immediate above the needle bed gap, the end yarn hook can undesirably interfere with knitting members flitting in the space, such as the yarn feeder, a brush and the like. This problem will particularly be presented for a knitting machine equipped with a plurality of yarn feeders. Further, in the case where a knitting needle damaged in the course of the knitting remains above the needle bed gap without returning to its original position by an operating cam on the carriage, there is a possible fear that the moving end yarn hook may collide with the needle to break it.

SUMMARY OF THE INVENTION

An object of the present invention is to reduce presence of the above-mentioned problems by putting the end yarn hook into action only when necessary but otherwise retreating it to its retreated position.

Another object of the present invention is to retreat the end yarn hook to a position in the vicinity of the needle bed gap and deviating from the paths of the knitting members including the yarn feeder and the knitting needles.

A still another object of the present invention is to voluntarily change the process of handling the end yarn in accordance with the knitting conditions.

To accomplish the abovesaid objects, the present invention provides an end yarn inserting device of a flat knitting machine comprising guide rails supported by supporting brackets spaced right and left on needle beds at the opposite ends and extending in parallel along and over the needle beds, an end yarn inserting portion including an end yarn hook supported in reciprocally movable relation over the guide rails, a first control portion for controllably moving the end yarn inserting portion to a desired position above the needle bed gap, and a second control portion for controlling a vertical movement of the end yarn hook, wherein the end yarn inserting portion comprises an end yarn hook having a hook portion for retaining a cross-over yarn thereon and an end yarn hook presser foot having a presser foot for holding the cross-over yarn retained on the hook portion down, the end yarn hook and the end yarn hook presser foot being superposed on each other and swingably journaled around a journal portion provided on a base slidably supported on the guide rails; and wherein a control means for controlling a back and forth swinging motion of the end yarn hook is provided between the end yarn hook and the base so that when the end yarn hook and the end yarn hook presser foot are swung between their retreat positions and their lowered positions by the drive of the second control portion, the hook portion and the presser foot portion can move along a trail to prevent interfering with a sinker projecting upward from the needle bed.

In the end yarn inserting device above, the first control portion comprises a driving motor provided at a lateral side of the guide rail and reciprocating motion converting means, provided along the guide rail, for converting a rotational drive of the motor into a reciprocating motion to move the end yarn inserting portion connected to one end of a transmitting portion to a desired position on the needle bed and wherein the second control portion comprises a driving motor provided at a lateral side of the guide rail and vertical reciprocating motion conversion means, provided along the guide rail, for converting the rotational drive of the motor into a vertical movement.

The reciprocating motion converting means of the first control portion comprises a pinion mounted on a motor shaft and a rack engaged with the pinion and sidably arranged over the guide rail.

The vertical reciprocating motion conversion means of the second control portion comprises a crank shaft mounted on a motor shaft, a first lever journaled on the shaft, and a second lever carried on the guide rail through the linkage and connected with the first lever at one end thereof.

According to this invention, the first control portion drives the end yarn inserting portion supported on the guide rail reciprocally in the X-axis direction. This enables the rotational drive of the driving motor provided at a lateral side of the guide rail to be converted into the reciprocating motion, to permit the reciprocating motion of the transmission portion connected with the end yarn inserting portion at one end thereof. Controlling the rotational drive of the X-axis motor can permit the end yarn inserting portion to be moved to a desired position on the needle bed in accordance with the knitting process. When the reciprocating motion converting means is composed of a pinion mounted on a motor shaft and a rack slidably arranged over the guide rail and the end yarn inserting portion is mounted on one end of the rack, the rotational drive of the motor is converted into the reciprocating motion of the rack, so that the end yarn inserting portion can be moved to a desired position on the needle bed.

The second control portion drives the end yarn hook of the end yarn inserting portion supported on the guide rail toward the Y-axis direction. The rotational drive of the driving motor provided at a lateral side of the guide rail is converted into the reciprocating motion via the vertical reciprocating motion conversion means to permit the vertical reciprocating motion of the transmission portion provided along the guide rail. When the vertical reciprocating motion conversion means is composed of the crank shaft mounted on the motor shaft, the first lever, the linkage and the second lever, the rotational drive of the motor causes the crank shaft to rotate, which in turn permits the reciprocating motion of the first lever. This reciprocating motion is transmitted to the second lever supported on the guide rail via the linkage to shift the second lever vertically. The vertical reciprocating motion of the second lever of the second control portion is transmitted to the end yarn hook and the end yarn hook presser foot which are superposed on each other and swingably supported in the end yarn inserting portion. When the second lever is raised, the end yarn hook and the end yarn hook presser foot are swung to their retreat positions, while on the other hand, when the second lever is lowered, the end yarn hook and the end yarn hook presser foot are swung to their capturing positions. The hook portion and the hook presser foot are made to swing back and forth direction via the back and forth swinging motion controlling means provided between the end yarn hook and the base so that they can be swung from the retreat positions in the vicinity of the needle bed gap and deviating from the paths of the knitting members including the yarn feeder and the knitting needles to the capturing positions within the knitting area located immediately above the needle bed gap, and vice versa, without colliding with the sinker.

According to the invention, only when it is necessary to deal with the cross-over yarn appearing between the finger portions of the respective fingers, as is the case with the knitting of a glove, the motors are driven for controlling the position of the end yarn hook in the X-axis direction and the Y-axis direction to bring the end yarn hook of the end yarn inserting portion retreated to the retreat position into the knitting area so that the cross-over yarn can be held by the end yarn hook and then be inserted into the finger portion. This can produce the result of preventing the end yarn hook from interfering with the knitting members including the knitting needle, the yarn feeder and the brush. Also, even when a damaged knitting needle remains on the needle bed, a possible fear of collision of the end yarn hook with the damaged knitted needle can be reduced. Also, the process of handling the end yarn can be selectively changed by controlling the motors for controlling the X-axis position and the Y-axis position in accordance with the knitting conditions.

DETAILED DESCRIPTION OF THE PREFERRED EMBODIMENT

Figure 1:
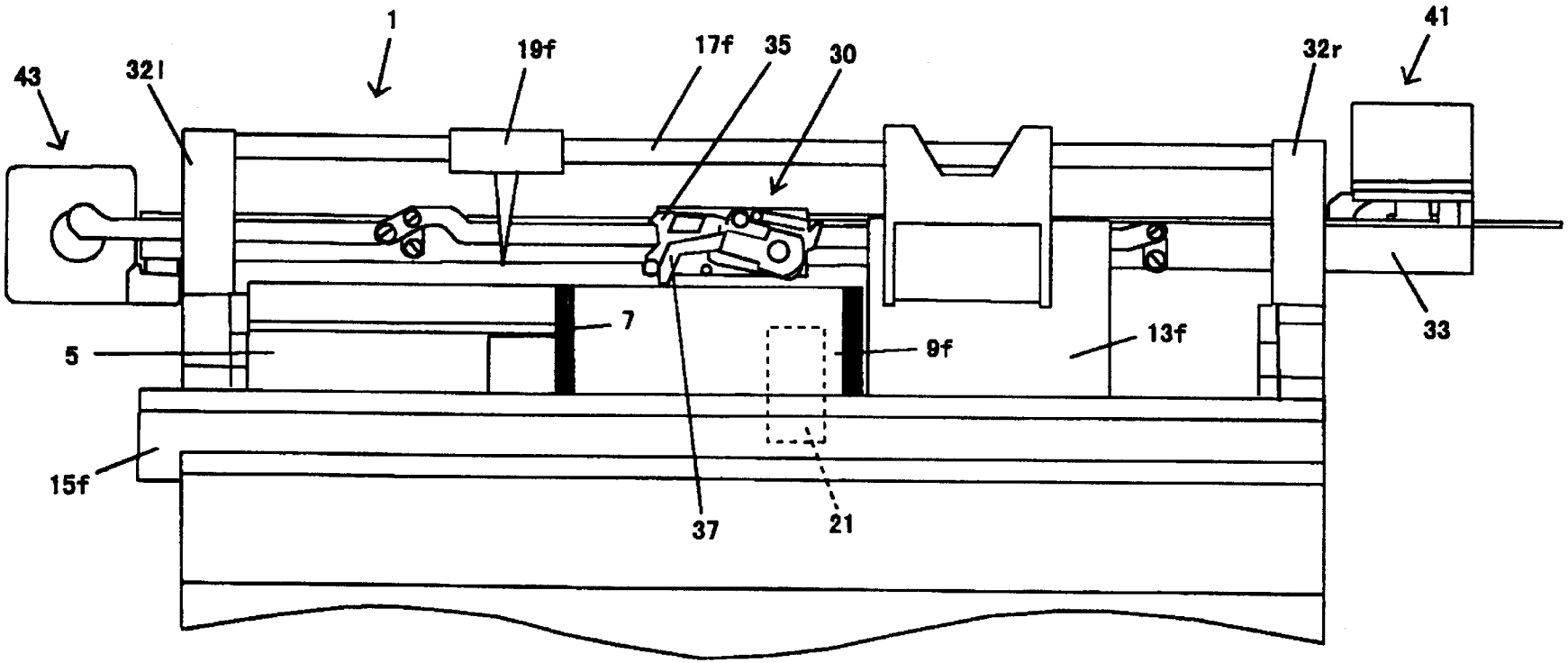
FIG. 1 is a schematic front view of a glove-knit-use flat knitting machine of one embodiment of the invention.
Figure 2:
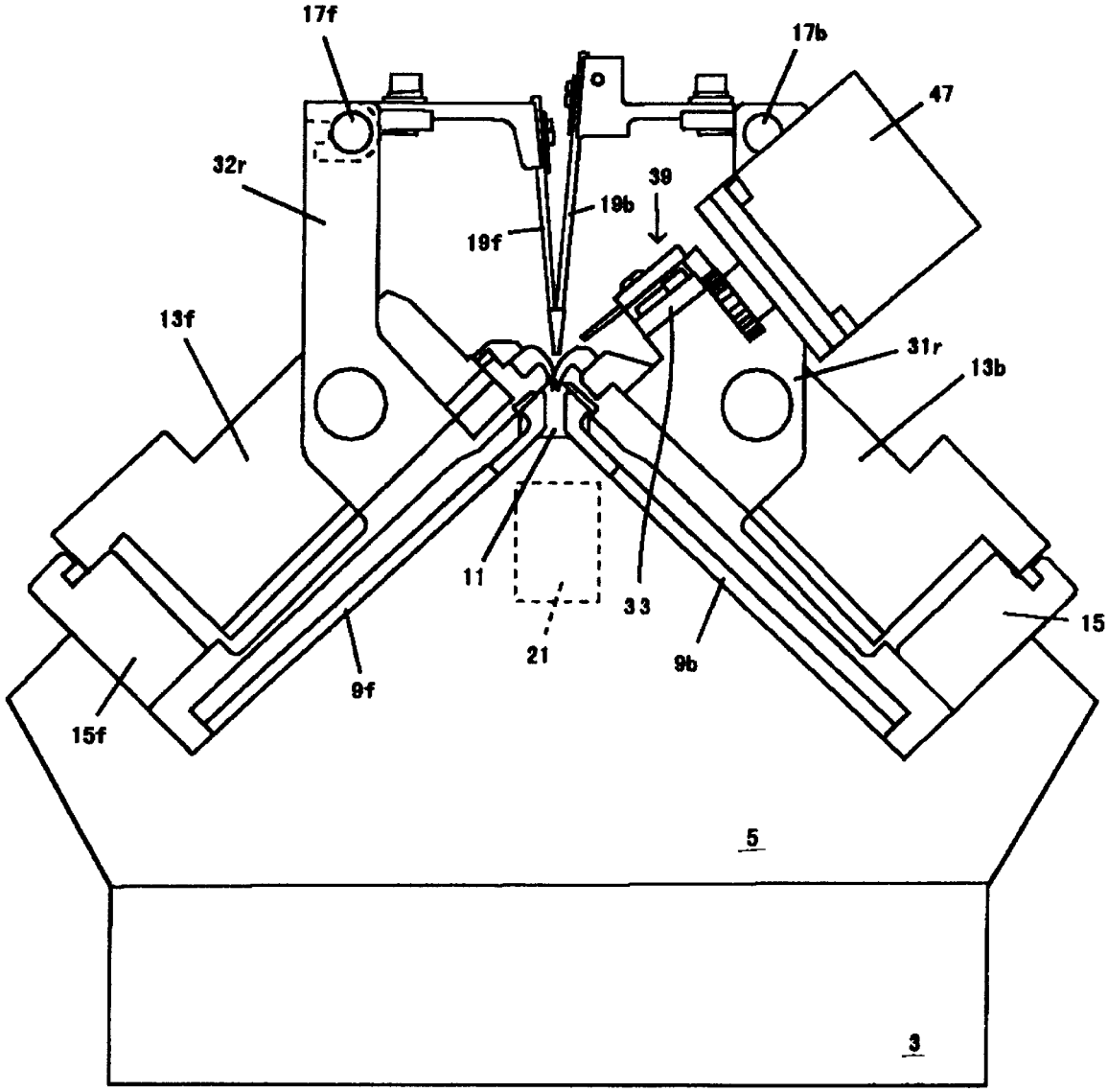
FIG. 2 is a side view of the flat knitting machine.
Figure 3:
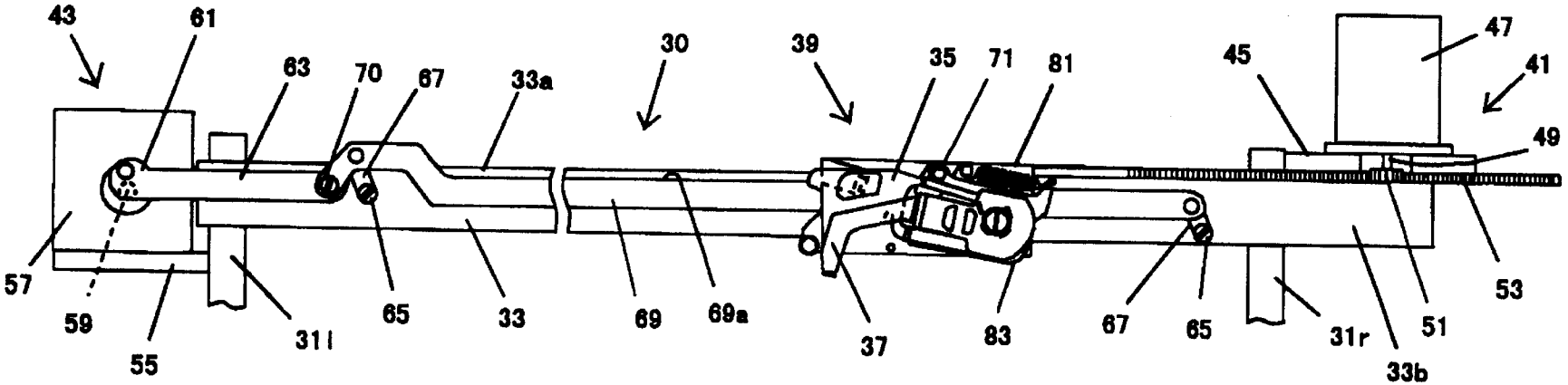
FIG. 3 is a showing of an entirety of an end yarn inserting device.

With reference to the accompanying drawings, an example of the preferred embodiment of the end yarn inserting device of the flat knitting machine of the present invention will be described below. FIG. 1 is a schematic front view of a glove knitting machine as a flat knitting machine; FIG. 2 is a side view thereof; and FIG. 3 is an enlarged view of the end yarn inserting device provided in the glove knitting machine.

In the glove knitting machine 1, a pair of front and back needle beds 9*f*, 9*b* containing a number of knitting needles 7 are disposed on an angle base 5 in an inverted V form in side configuration, with their needle bed gap 11 close to each other. Carriages 13*f*, 13*b* for driving the knitting needles 7 back and forth are guided in carriage rails 15*f*, 15*b* on the upper surfaces of the needle beds 9*f*, 9*b*. The carriages 13 are mounted on the carriage rails in such a manner as to be moved reciprocally over the needle beds along the carriage rails 15 by a drive means (not shown). Supporting brackets 31*r*, 31*l* and 32*r*, 32*l* are provided at the lateral sides above the needle beds 9, and yarn guide rails 17*f*, 17*b* are supported by the supporting brackets, respectively. Yarn feeders 19*f*, 19*b* are mounted on the yarn guide rails 17 in such a manner as to be movable in reciprocation.

The glove knitting machine 1 is provided with a cross-over yarn cutting and gripping device 21 which is located under the needle bed gap and is movable in a widthwise direction of the needle beds 9, 9, as in a known glove knitting machine. The cross-over yarn cutting and gripping device cuts a cross-over yarn appearing between a base end portion of the finger portion and a fingertip of the finger portion to be knitted next and grips it when the finger portions are knitted.

Next, description on an end yarn inserting device 30 of an embodiment of the invention will be given. The end yarn inserting device 30 comprises a guide rail 33 extending horizontally over the back needle bed 9*b* on the whole, an end yarn inserting portion 39 including an end yarn hook 35 and an end yarn hook presser foot 37, a first control portion 41 for permitting the reciprocating motion of the end yarn inserting portion 39 and controlling a position of the same in a lengthwise direction of the needle beds, and a second control portion 43 for controlling the vertical reciprocating motion of the end yarn hook. The guide rail 33 is supported at its opposite ends by the supporting brackets 31*r*, 31*l*, as in the case with the yarn guide rail 17*b*.

The first control portion 41 comprises a driving motor 47, such as a pulse motor, that permits position control and is mounted on the supporting bracket 31*r*, located at the right side for supporting thereon the guide rail 33, through a motor mount 45, and a reciprocating motion converting means for converting the rotational drive of the motor into the reciprocating motion of the end yarn inserting portion 39. In the illustrated embodiment, the reciprocating motion conversion means is composed of a pinion 51 mounted on a motor shaft 49 of the motor 47 and a rack 53 engaged with the pinion 51 sidably over a upper surface 33*a* of the guide rail. The end yarn inserting portion 39 is mounted on a left side end of the rack 53. The motor shaft 49 is driven for rotation by the drive of the driving motor 47, so that the rack 53 can be moved reciprocally along the widthwise direction of the guide rail 33 to move the end yarn inserting portion 39 to any selected position on the needle bed.

The second control means 43 comprises a driving motor 57, such as a pulse motor, that is mounted on the supporting bracket 31*l*, located at the left side for supporting thereon the guide rail 33, through the motor mount 55, and a vertical reciprocating motion converting means for converting the rotational drive of the motor 57 into the vertical reciprocating motion of the hook portion 127 of the end yarn hook 35 and the presser foot portion 147 of the end yarn presser foot 37 provided at the end yarn inserting portion 39. In the illustrated embodiment, the vertical reciprocating motion converting means is composed of a crank shaft 61 mounted on a motor shaft 59 of a motor 57, a first lever 63 journaled on the crank shaft 61, linkages 67, 67 carried on a front surface 33*b* of the guide rail at one end thereof by set screws 65,65, and a second lever 69 carried on the linkages 67, 67 at the other end thereof. The first lever 63 and the second lever 69 are journaled and connected together by a screw 70 at side end portions thereof. The rotational movement of the motor shaft 59 of the driving motor 57 is converted into the reciprocating motion of the first lever 63 and, thereafter, the movement of the second lever 69 is converted into a movement (vertical reciprocating motion) perpendicular to a lengthwise direction of the guide rail 33 through the linkage mechanism. As mentioned later, an upper surface 69*a* of a second lever 69 forms a rolling surface of a control roller 71 for controlling vertical positions of the end yarn hook 35 and the end yarn hook presser foot 37 provided in the end yarn inserting portion 39. The vertical positions of the end yarn hook 35 and the end yarn hook presser foot 37 are controlled by shifting the second lever 69 vertically by the driving motor 57.

Figure 4:
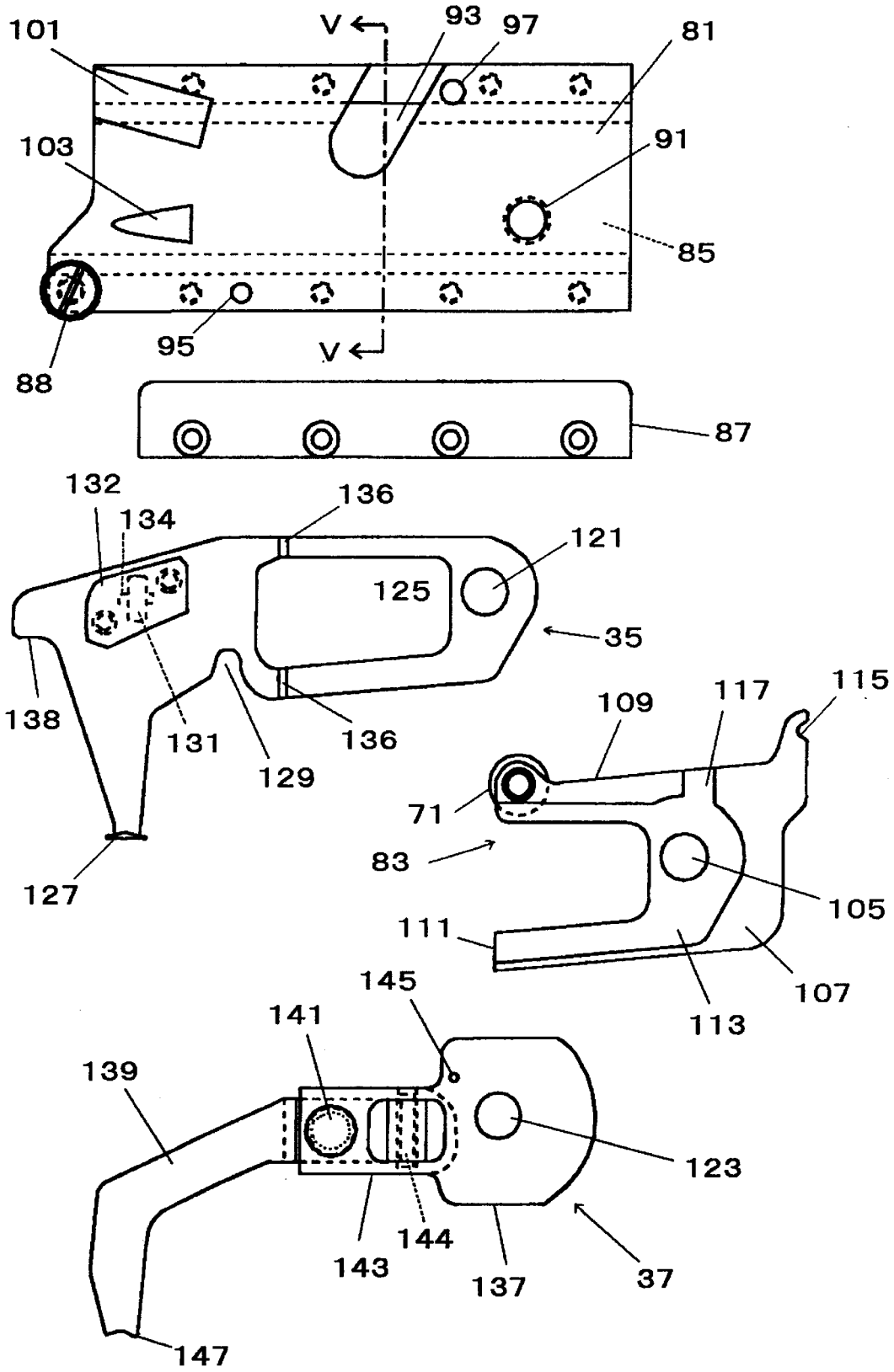
FIG. 4 is a showing of main components of the end yarn inserting portion.
Figure 5:
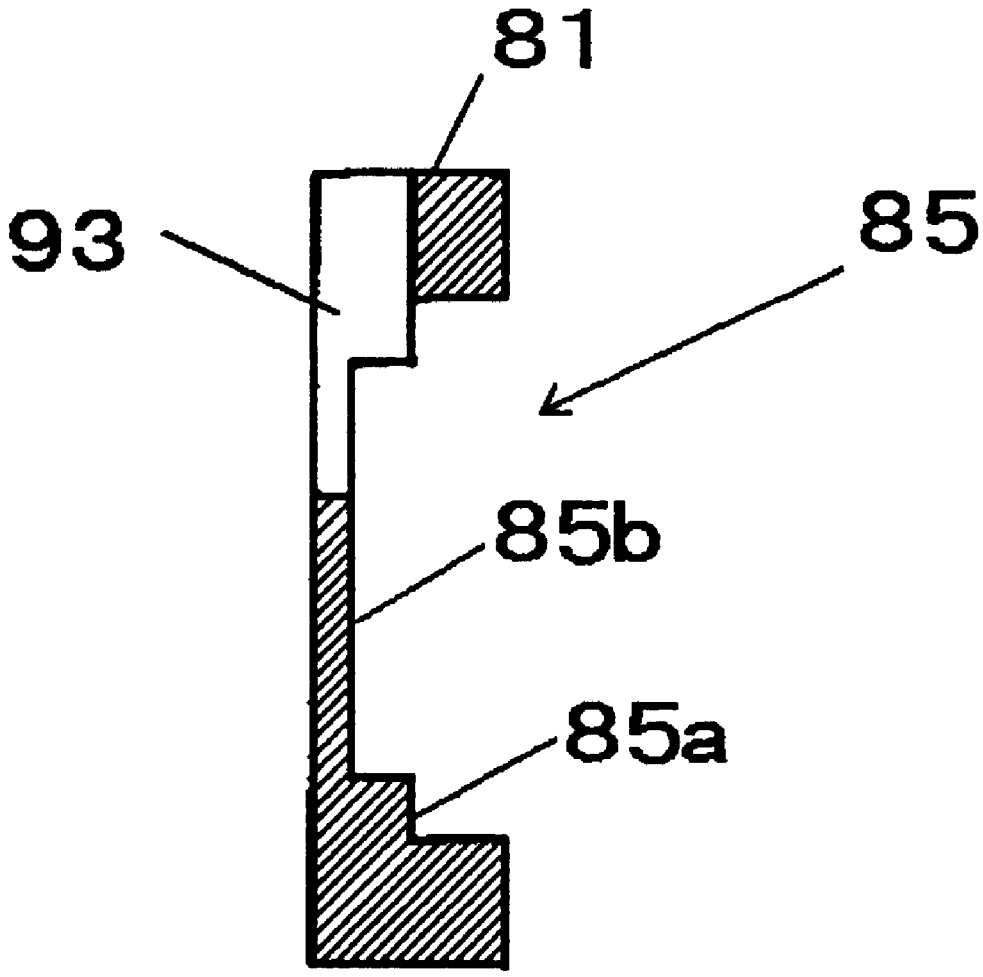
FIG. 5 is a sectional view of the base taken along the arrowed line V—V of FIG. 4.
Figure 6:
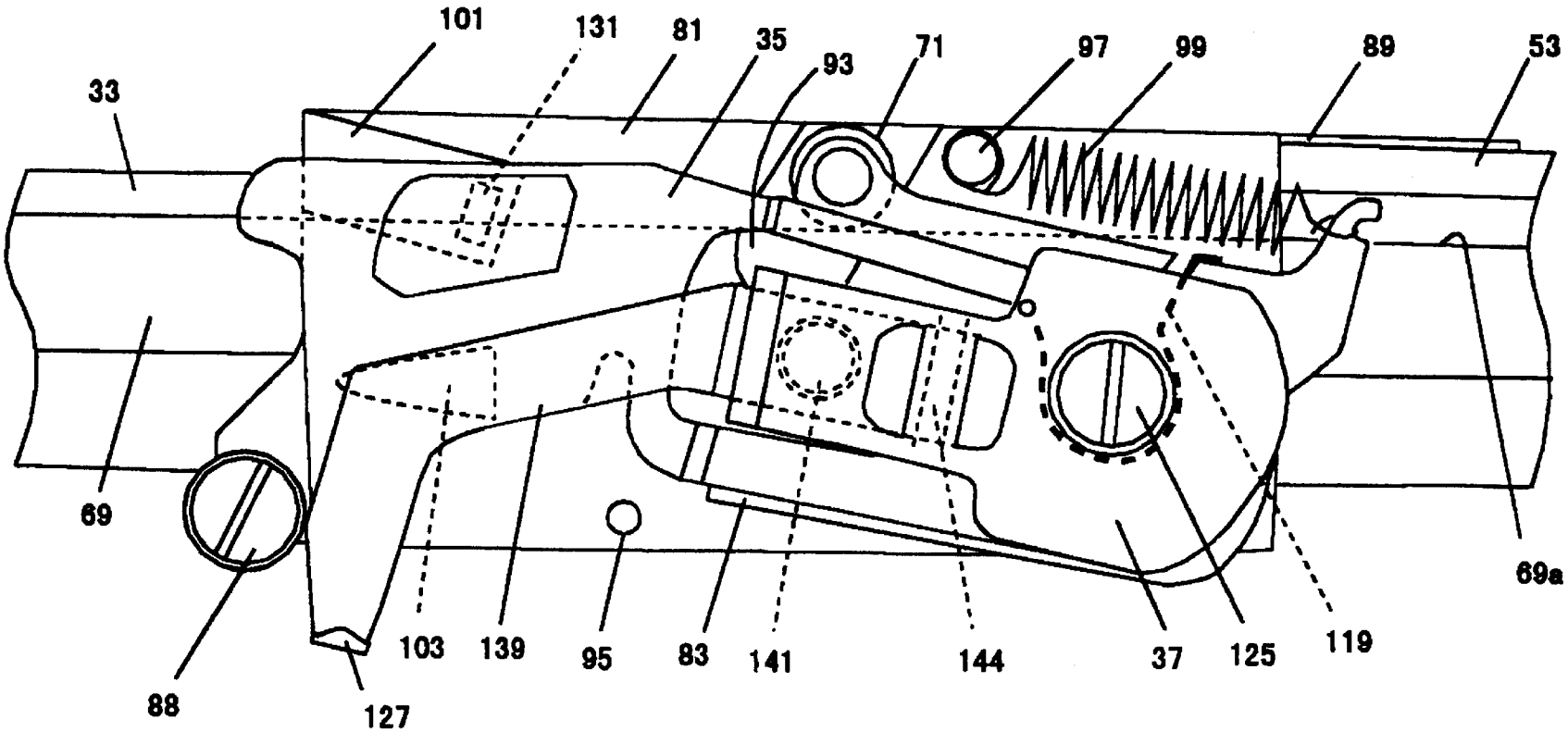
FIG. 6 is a view showing the state in which a hook portion and a presser foot portion which are provided at an end yarn hook of an end yarn inserting portion and the end yarn hook presser foot at the tips thereof, respectively, are retreated from the knitting area.
Figure 7:
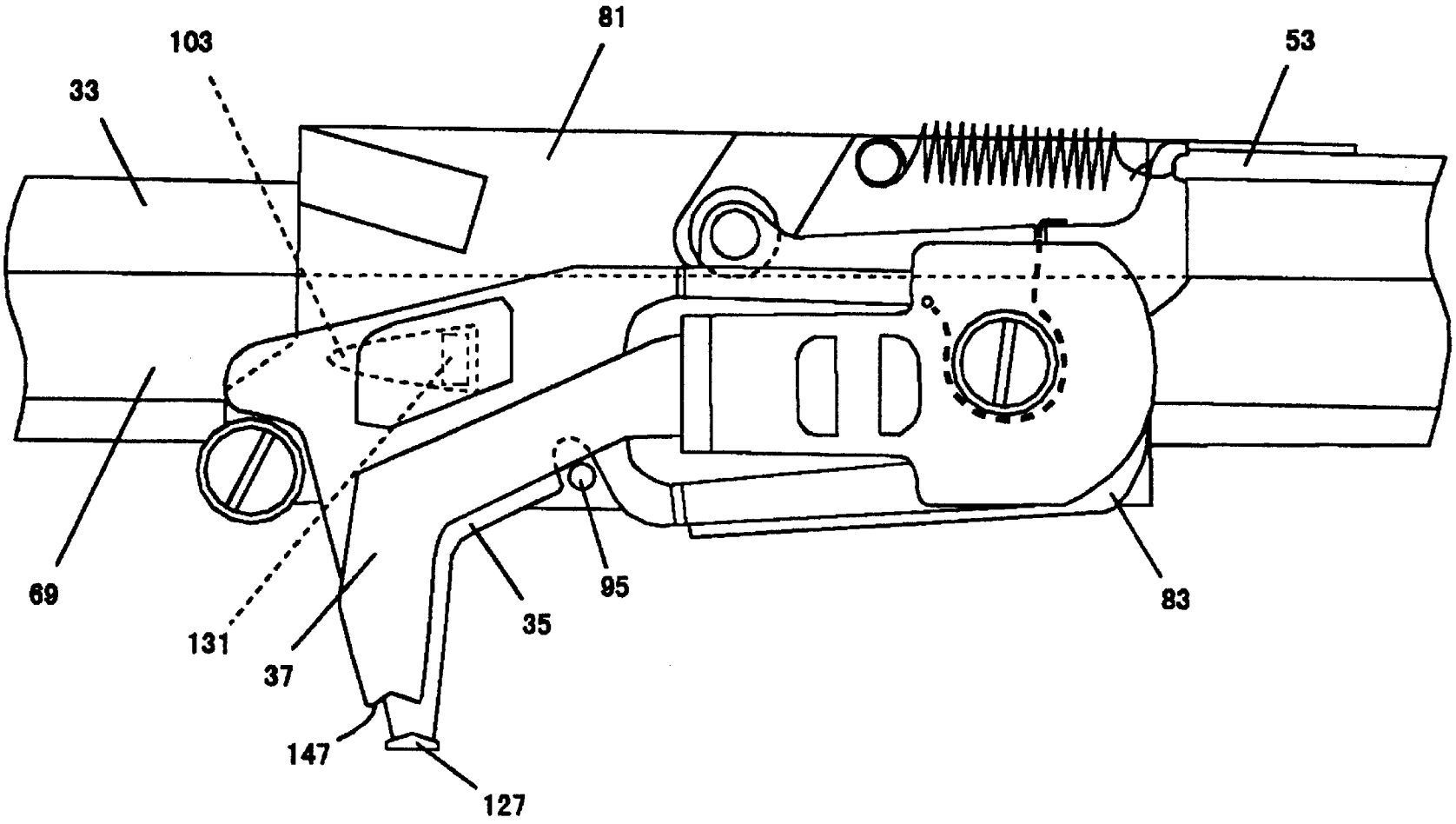
FIG. 7 is a view showing the state (opened state) in which the hook portion of the end yarn hook and the presser foot portion of the end yarn hook presser foot are lowered to open a space between the hook portion and the presser foot portion.
Figure 8:
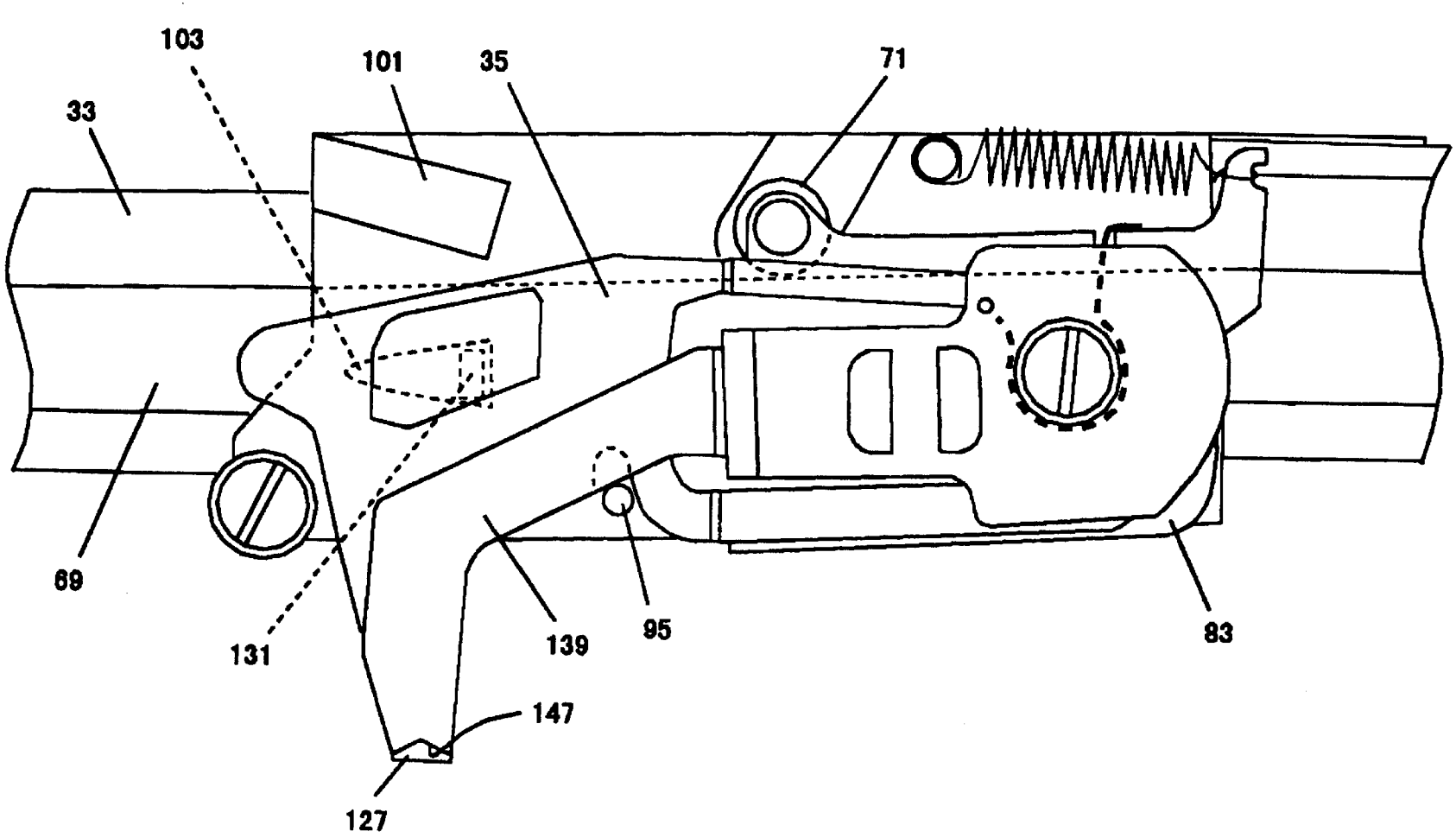
FIG. 8 is a view showing the state (closed state) in which the hook portion of the end yarn hook is raised to be brought into abutment with the presser foot portion.

Next, description on the end yarn inserting portion 39 will be given. FIG. 4 shows main components of the end yarn inserting portion 39. FIG. 5 is a sectional view of the base 81 taken along the arrowed line V—V of FIG. 4. FIGS. 6–8 show the end yarn inserting portion 39 supported by the guide rail 33. FIG. 6 shows the state in which the hook portion 127 and a presser foot portion 147, which are provided at the end yarn hook 35 and the end yarn hook presser foot 37 of the end yarn inserting portion at the tips thereof, respectively, are retreated from the knitting area immediately above the needle bed gap. FIG. 7 shows the state (opened state) in which the hook portion 127 and the presser foot portion 147 are lowered to space the hook portion 127 and the presser foot portion 147 from each other. FIG. 8 shows the state (closed state) in which the hook portion 127 of the end yarn hook 35 is raised and brought into abutment with the presser foot portion 147.

The base 81 has a generally U-like shape in side configuration, forming a concave 85 on its surface confronting the guide rail 33. The concave 85 comprises a shallow concave portion 85*a* and a deep concave portion 85*b*. The base is slidably fitted in the guide rail 33, with the shallow concave portion 85*a* as a bearing surface, and the second lever 69 of the second control portion 43 is fitted in the deep concave portion 85*b*. A supporting plate 87 is mounted on the base 81 at the back thereof, to prevent the base 81 from falling off from the guide rail 33. The base 81 and the rack 53 are connected together by a connecting plate 89 provided on the upper surface of the base 81. The base 81 has a journal portion (through bore) 91 which is formed on the front surface of the base 81 at the right side as a swinging fulcrum of an end yarn hook holder 83, the end yarn hook 35 and the end yarn presser foot 37. An aperture 93 formed on a front surface of the base at the center communicates to the deep concave portion 85*a*, allowing a control roller 71 of the end yarn hook holder 83 as mentioned later to be located on the second lever 69 extending through the base. 95 designates a stopper pin for limiting a lowered position of the end yarn hook presser foot 37. 97 designates a retaining pin for a spring 99 to be mounted between the retaining pin and the end yarn hook holder 83. 101 and 103 designate recessed portions of the front surface of the base being circularly cut out. The pin 88 provided on a lower end portion of the base 81 at the left side is an eccentric pin. An engaging surface 138 of the end yarn hook 35 is brought into abutment with the eccentric pin only when a downward swinging motion of the end yarn hook 35 exceeds a predetermined amount. The eccentric pin can be adjusted in position to adjustably change the lowered position the hook portion 127 into a proper position.

The end yarn hook holder 83 has a generally U-like shape having a receiving portion 113 for receiving the end yarn hook 35 and the end yarn hook presser foot 37. The receiving portion 113 is formed by cutting out a body portion 107 having a shaft insertion hole 105 and vertically arranged arms 109, 111 around the inside thereof. A roller 71 is rotatably mounted on the upper arm 109 of the end yarn hook holder 83 at the end thereof. 115 designates a spring retaining portion provided at an upper end portion of the body portion 107 at the right side thereof. 117 designates a retaining portion of a helical spring 119 as mentioned later.

The end yarn hook 35 and the end yarn hook presser foot 37 are received in sequence in the receiving portion 113 and then are swingably fixed to the journal portion 91 of the base 81 by a set screw 125 being inserted in insertion holes 121, 123 which are formed in the end yarn hook 35 and the end yarn hook presser foot 37, respectively. The spring 99 is mounted between the spring retaining portion 115 and the retaining pin 97 on the base 81 to bias the end of the arm in a counterclockwise direction around the journal portion 91, so as to bring the control roller 71 into press-contact with the upper surface 69*a* of the second lever 69 constantly. Thus, the back and forth swinging motion of the end yarn hook holder 83 and the end yarn hook 35 and the end yarn hook presser foot 37 received in the receiving portion 113 can be controlled by the driving motor 57 of the second control portion 43 being driven to shift the second lever 69 vertically.

The end yarn hook 35 is formed of a sheet plate member, having a rectangular through hole 125 at the center thereof, a journal-use through hole 121 at one end thereof, and the hook portion 127 at the other end thereof. 136 designates a folded portion for allowing an end portion of the end yarn hook 35 to be abutted with the base 81 in the state in which the end yarn hook 35 is placed on the end yarn hook holder 83. 129 designates a cutout for keeping the end yarn hook from interference with the stopper pin 95 provided in the base 81 when swung downward. 138 designates an abutting surface of the end yarn hook to be abutted with the eccentric pin 88 provided in the base 81. 132 designates a roller mounting portion in which a roller 131 provided in a surface of the end yarn hook confronting the base 81 is rotatably journaled by a pin 134 provided in the mounting portion 132. The roller 131 is in press-contact with the front surface of the base 81 in the state in which the end yarn hook 35 is mounted on the base. At the retreat position of the end yarn hook 35 raised, the roller 131 is rolled into the upper recessed portion 101 provided in the upper portion of the base 81. When the end yarn hook 35 is lowered, the roller 131 is rolled out of the recessed portion 101 and then is retreated into the lower recessed portion 103. Thus, when the hook portion 127 of the end yarn hook 35 is switched from its operative position to its retreat position, and vice versa, the hook portion can take a path curved in a back and forth direction, to avoid interference with a sinker 135 projecting from the end of the needle bed 9*b*. The retreat position deviates rearwardly from the path of the knitting needles 7 of the front needle bed 9*f*, so that no interference of the end yarn hook with the knitting needles 7 and the yarn feeder 19 occurs.

The end yarn hook presser foot 37 comprises a body portion 137, a presser foot plate 139, and a coil spring 141 provided between the body portion 137 and the presser foot plate 139. The body portion 137 has a journal-use through hole 123 and a bearing portion 143 for bearing the presser foot plate 139. The presser foot plate 139 is journaled by a journal pin 144 and is put in press-contact with the end yarn hook 35 by the coil spring 141. 119 designates a helical spring, one end of which is retained in a spring retaining portion 117 of the end yarn hook holder 83 and the other end of which is retained in a spring fitting hole 145 of the end yarn hook presser foot 37. The helical spring 119 biases the presser foot portion 147 at the end of the presser foot plate 139 toward being press-contact with the hook portion 127 of the end yarn hook 35.

Next, operation of the end yarn inserting device 30 of the glove knitting machine thus constructed will be described.

As is the case with a known knitting process, in the knitting of a glove, a knitting yarn is fed to the knitting needles 7 on the needle beds 9 from the yarn feeder 19 that moves reciprocally in the longitudinal direction of the needle beds 9, to knit four finger portions (not shown) from their fingertip portions to the crotch portions, casting on stitches from the little finger to the third, second and first fingers of the glove in sequence. Thereafter, the knitting of an upper palm portion and the knitting of the subsequent thumb portion are performed, followed by the knitting of a lower palm portion and the knitting of a wrist portion, for the completion of knitting of the glove. Then, every time when the each finger portion is knitted, the cross-over yarn extending from the crotch portion of the finger portion to the yarn feeder is captured by the hook of the cross-over yarn cutting and gripping device 21 (FIG. 1) for a while and then is cut so that a portion of the end yarn extending toward the yarn feeder can be gripped by the cross-over yarn cutting and gripping device to cast the next finger portion on.

Figure 9:
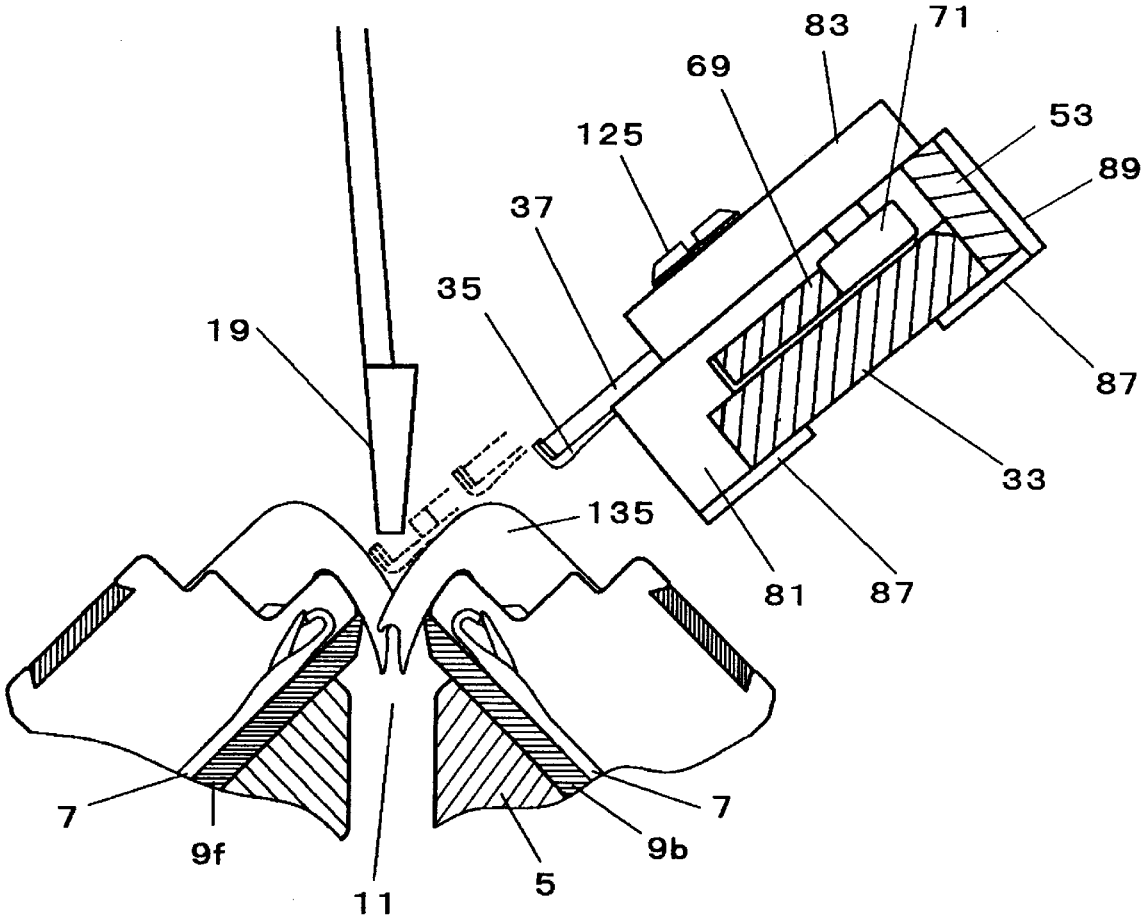
FIG. 9 is a view of the end yarn inserting device as viewed from the side, showing trails of the end yarn hook and the end yarn hook presser foot provided at the end of the yarn hook portion and the presser foot portion, with a solid line indicating the retreat position and broken lines indicating the captured position and intermediate position.

This will be discussed with reference to FIG. 10, taking the knitting from the finger portion of the little finger to the casting on stitches of the next finger portion of the third finger (ring finger) as an example. During the knitting of the finger portion, the end yarn hook 35 and the end yarn hook presser foot 37 of the end yarn inserting device 30 are in the raised retreat position. FIG. 9 shows trails in side configuration of the end yarn hook 35 and the end yarn hook presser foot 37 provided at the end of the end yarn hook portion 127 and the presser foot portion 147, with a solid line indicating the retreat position and broken lines indicating the captured position and the intermediate position.

The finger portion 155*a* of the little finger 155 is knitted, casting on stitches from the fingertip 155*b* to the crotch portion 155*c* of the finger 155 with a yarn 157 fed in a counterclockwise direction from the yarn feeder 19 to the knitting needles 7 on the front and back needle beds 9*f*, 9*b* that are moved back and forth by the carriage 13. After the completion of knitting of the courses of the finger portion of the little finger 155 on the back needle bed, the yarn feeder 19 is moved to the left side in a section P in which the finger portion of the third finger is knitted (FIG. 10-*a*). In this state, the cross-over yarn cutting and gripping device 21 disposed under the needle beds 9 is operated to raise the hook 160. The hook 160 captures the cross-over yarn 157*a* extending between the yarn feeder 19 and the knitting needle 7*n* on the back needle bed that retains the final stitch loop of the finger portion of the little finger 155 and, then, the hook 160 is lowered down to cut the cross-over yarn 157*a* and grip it (FIG. 10-*b*). A portion of the cross-over yarn extending to the little finger by the cutting is inserted into the finger portion of the little finger 155 in a manner as illustrated.

Next, the driving motor 47 of the end yarn inserting device 30 is operated to move the end yarn hook 35 and the end yarn hook presser foot 37 provided in the end yarn inserting portion 39 to the left side of the knitting needles in the section P in which the finger portion of the third finger is knitted. During this movement, the driving motor 57 of the second control portion 43 is not driven, so that the end yarn hook 35 and the end yarn presser foot 37 are kept in their retreat positions (the state of FIG. 10-*c* and FIG. 6).

After completion of the movement of the end yarn hook 35 and the end yarn hook presser foot 37, the driving motor 57 is driven to shift the second lever 69 downward so as to lower the hook portion 127 and the presser foot portion 147 (the capturing position). In this capturing position, the hook portion 127 is in a lower level than the end of the yarn feeder 19 (the state of FIG. 10-*d* and FIG. 7).

While the end yarn hook 35 and the end yarn hook presser foot 37 swing from the retreat positions to the capturing positions, the roller 131 provided in the end yarn hook 35 turns over the front surface of the base 81 and rolls out of the circular recessed portion 101 and then rolls into the lower recessed portion 103 again. So, the end yarn hook 35 and the end yarn hook presser foot 37 laid on the end yarn hook 35 moves along a circular path, so that the hook portion 127 provided at the end of the end yarn hook 35 and the presser foot portion 147 provided at the end of the end yarn hook presser foot 37 are prevented from interfering with the sinker 135 projecting from the end of the needle bed and is set in place directly over the needle bed gap. At this time, the end yarn hook 35 and the end yarn presser foot 37 swing together with the end yarn hook holder 83, but the end yarn hook presser foot 37 swings less than the end yarn hook 35 to the extent of the swinging of the end yarn hook presser foot 37 being limited by abutment with the stopper pin 95 provided at the base 81, so that the hook portion 127 and the presser foot portion 147 are spaced apart in the capturing position. During this process, the hook 160 of the cutting and gripping device 21 holding the portion of the end yarn at a position under the needle bed gap is moved to the left side in the section P in which the finger portion of the third finger is knitted.

In this state, the yarn feeder 19 is moved rightward to feed the knitting yarn 157 to the knitting needles for knitting the finger portion of the third finger, so as to cast on stitches of the fingertip 161. This movement of the yarn feeder 19 causes the portion of the cross-over yarn 157*a* extending from the hook 160 of the cross-over yarn cutting and gripping device 21 placed under the needle bed gap to the yarn feeder 19 to be guided into between the hook portion 127 of the end yarn hook 35 and the presser foot portion 147 which are in the state of being spaced apart from each other and entwined itself round the hook portion 127 (the state of FIG. 10-*e* and FIG. 7).

Then, the cross-yarn cutting and gripping device 21 is operated to release the portion of the end yarn 157*a* from the hook 160 and simultaneously the driving motor 57 is driven to shift the second lever 69 upward. This causes the end yarn hook holder 83 to swing in a clockwise direction to raise the end yarn hook 35 first, so as to hold the portion of the end yarn 157*a* as has just been released from the hook 160 in sandwich relation between the hook portion 127 and the presser foot portion 147 (the state of FIG. 8). Then, the further swinging motion of the end yarn hook holder 83 causes the end yarn hook 35 and the end yarn hook presser foot 37 holding the end yarn 157*a* in sandwich relation therebetween to be raised without interfering with the sinker 135 and guided to the retreat position deviating rearward from the path of the knitting needles 7 moving back and forth (the state of FIG. 10-*f* and FIG. 6). Since the retreat position is located in such a position as mentioned above, despite of the small swinging stroke, the end yarn hook 35 and the end yarn hook presser foot 37 can be prevented from interfering with the yarn feeder 19 and the knitting needles 7 and also can reliably hold the end yarn 157*a* in sandwich relation between the hook portion 127 and the presser foot portion 147. Further preferably, when the end yarn hook 35 and the end yarn hook presser foot 37 are swung to the retreat positions, the X-axis driving motor 47 is controllably driven so that the cross-over yarn 157*a* can be oriented vertically, to shift the end yarn inserting portion 39 rightward. This can permit the cross-over yarn to be inserted in the finger portion further reliably, without occurrence of looseness in the cross-over yarn, as illustrated later in FIG. 10-*h*.

Figure 10:
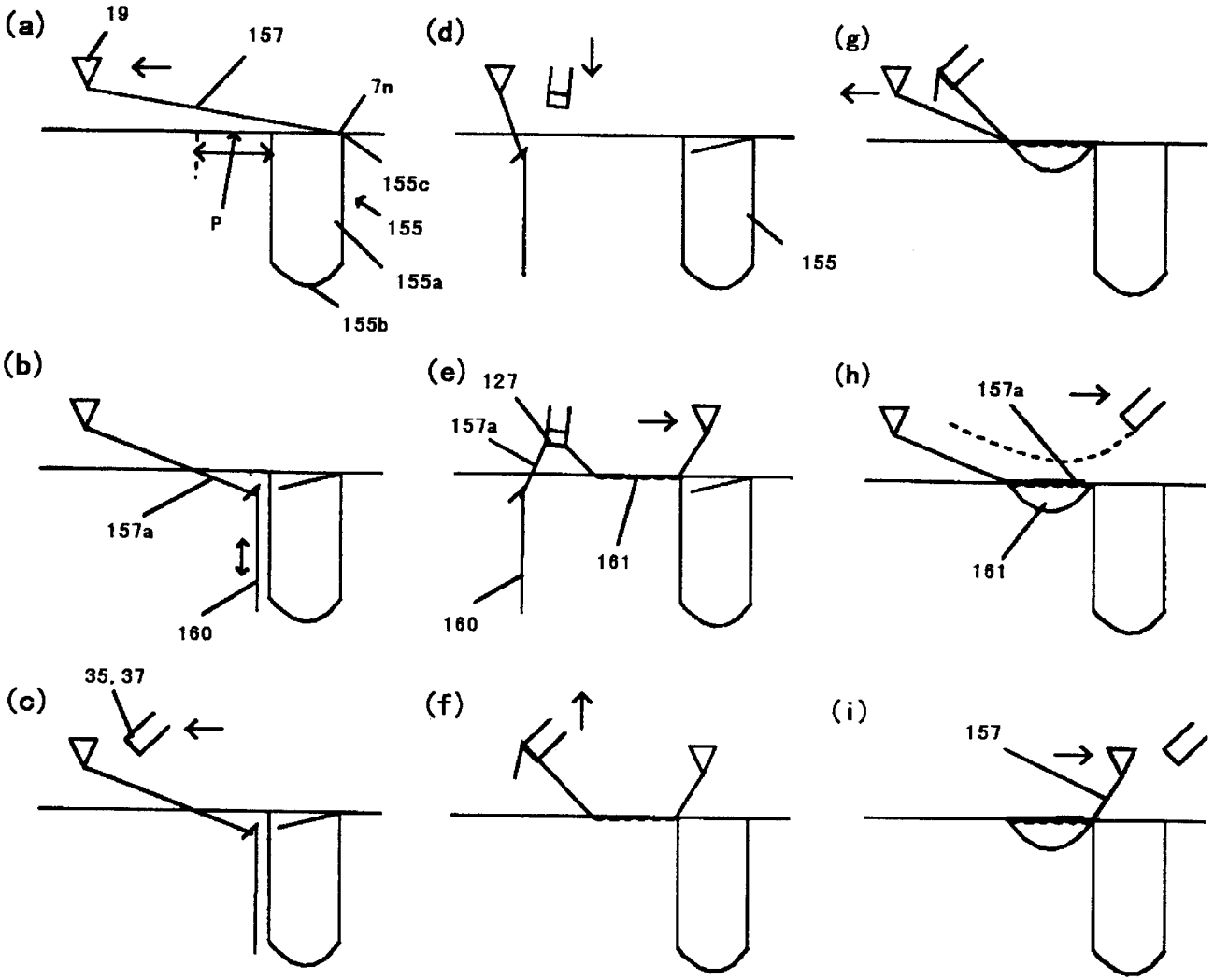
FIG. 10 is a diagram showing in order the end yarn processes in the knitting the glove by use of the end yarn inserting device of the embodiment of the invention.

After some courses of the fingertip of the finger portion of the third finger 161 is knitted and the yarn feeder 19 is shifted to the left side of the finger portion (FIG. 10-*g*), the driving motors 47 and 57 of the first and second control portions 41 and 43 are driven so that the hook portion 127 of the end yarn hook 35 can swing along a trail shown in FIG. 10-*h* (broken line), to insert the end yarn 157*a* held by the end yarn hook 35 and the end yarn hook presser foot 37 into the finger portion. Thereafter, the end yarn hook 35 and the hook presser foot 37 are retreated to the retreat positions again and also the end yarn inserting portion 39 is shifted to a position beyond the finger portion. Following the insertion of the end yarn 157*a*, following courses of the finger portion 161 are knitted with the yarn feeder 19 (FIG. 10-*i*).

The trail of the end yarn hook 35 moving in the direction of the X-axis and Y-axis can be changed selectively by changing the output timing of the driving motors 47, 57, so that the inserting process of the end yarn can be changed in accordance with the knitting conditions.

Next, a variant of the above-illustrated embodiment will be discussed. While in the above-illustrated embodiment the example is given in which the end yarn hook is used once for handling the cross-over yarn appearing between the finger portions of the little finger and the third finger, in this variant an example is given in which the end yarn hook is used also for handling the cross-over yarn extending toward the little-finger finger portion that is to be cut by the cross-over yarn cutting and gripping device.

This will be discussed with reference to the preciously referred FIG. 10. First, a knitting yarn is fed in a clockwise direction to knit the finger portion 155*a* of the little finger 155. The knitting of the little finger 155 is done in such a manner that the stitch loop to be finally formed is allocated to the knitting needle at the left side of the front needle bed or the back needle bed. Before the completion of knitting of the little finger, the X-axis motor 47 and the Y-axis motor 57 are driven so that the end yarn hook 35 can be set in the capturing position at the left side of the little finger 155, to shift the end yarn inserting portion 39. Then, the yarn feeder 19 after completion of the knitting of little finger 155 is shifted to the left side of the third finger. When the yarn feeder 19 is moved beyond the end yarn hook 35, the cross-over yarn goes into between the hook portion 127 of the end yarn hook 35 and the presser hook portion 147. In this state, the cross-over yarn cutting and gripping device 21 is operated to cut the cross-over yarn 157 and grip it with the hook 160 and also swing the end yarn hook from the capturing position to the retreat position so that the portion of the end yarn extending from the little finger to the hook 160 of the cross-over yarn cutting and gripping device 21 can be gripped by the end yarn hook 35 and the presser foot 37. Then, the motors 47, 57 are driven to move the end yarn hook 35 along a trail shown in FIG. 10-*h* with respect to the little finger 155, to insert the end yarn held by the end yarn hook 35 into the finger portion of the little finger.

Thereafter, the end yarn inserting portion 39 is moved to produce the state shown in FIG. 10-*c* and, thereafter, the processes of FIGS. 10-*d* to 10-*i* are done, as is in the case with the former embodiment, to insert the cross-over yarn 157*a* extending from the cross-over yarn cutting and gripping device 21 to the yarn feeder 19 into the finger portion of the third finger 161.

Next, a further variant of the end yarn insertion will be described. In this variant, in place of the processes of FIGS. 10-*h* to 10-*i*, the processes are taken in which the hook portion 127 of the end yarn hook 35 is lowered to a level equal to the yarn feeder 19 and also the driving motors 47, 57 of the first and second control portions 41, 43 are controlled so that the end yarn inserting portion 39 can be moved together with the yarn feeder 19 while slightly advancing with respect to the yarn feeder 19. This can produce the result that the end yarn 157*a* retained by the end yarn hook 35 and the knitting yarn 157 of the yarn feeder 19 are paralleled so that they can be knitted into the knitting course of the fingertip.

The present invention is not limited to the above-illustrated embodiments. Modifications may be made in the invention such as, for example, using a linear motor, an air cylinder and the like, as the driving means, in place of the driving motor such as the pulse motor, for controlling the drive of the end yarn hook in the direction of the X-axis and the Y-axis, without departing from the sprit of the present invention.

What is claimed is:

1. An end yarn inserting device of a flat knitting machine comprising guide rails supported by supporting brackets spaced right and left on needle beds at the opposite ends and extending in parallel along and over the needle beds, an end yarn inserting portion including an end yarn hook supported in reciprocally movable relation over the guide rails, a first control portion for controllably moving the end yarn inserting portion to a desired position on the needle bed, and a second control portion for controlling a vertical movement of the end yarn hook, wherein the end yarn inserting portion comprises an end yarn hook having a hook portion for retaining a cross-over yarn thereon and an end yarn hook presser foot having a presser foot for holding the cross-over yarn retained on the hook portion down, the end yarn hook and the end yarn hook presser foot being superposed on each other and swingably journaled around a journal portion provided on a base slidably supported on the guide rails; and wherein a control means for controlling a back and forth swinging motion of the end yarn hook is provided between the end yarn hook and the base so that when the end yarn hook and the end yarn hook presser foot are swung between their retreat positions and their lowered positions by the drive of the second control portion, the hook portion and the presser foot portion can move along a trail to prevent interfering with a sinker projecting upward from the needle bed.

2. An end yarn inserting device of a flat knitting machine according to claim 1, wherein the first control portion comprises a driving motor provided at a lateral side of the guide rail and reciprocating motion converting means, provided along the guide rail, for converting a rotational drive of the motor into a reciprocating motion to move the end yarn inserting portion connected to one end of a transmitting portion to a desired position on the needle bed and wherein the second control portion comprises a driving motor provided at a lateral side of the guide rail and vertical reciprocating motion conversion means, provided along the guide rail, for converting the rotational drive of the motor into a vertical movement.

3. An end yarn inserting device of a flat knitting machine according to claim 2, wherein the reciprocating motion converting means of the first control portion comprises a pinion mounted on a motor shaft and a rack engaged with the pinion and slidably arranged over the guide rail.

4. An end yarn inserting device of a flat knitting machine according to claim 2, wherein the vertical reciprocating motion conversion means of the second control portion comprises a crank shaft mounted on a motor shaft, a first lever journaled on the shaft, and a second lever carried on the guide rail through the linkage and connected with the first lever at one end thereof.

* * * * *